US009272390B2

(12) United States Patent
Shen et al.

(10) Patent No.: US 9,272,390 B2
(45) Date of Patent: Mar. 1, 2016

(54) PAD CONDITIONING TOOL HAVING SAPPHIRE DRESSING PARTICLES

(71) Applicant: TERA XTAL TECHNOLOGY CORPORATION, Hsinchu (TW)

(72) Inventors: Wen-Yen Shen, Hsinchu (TW); Jun-Wen Chung, Hsinchu (TW)

(73) Assignee: TERA XTAL TECHNOLOGY CORPORATION, Hsinchu (TW)

( * ) Notice: Subject to any disclaimer, the term of this patent is extended or adjusted under 35 U.S.C. 154(b) by 0 days.

(21) Appl. No.: 14/340,835

(22) Filed: Jul. 25, 2014

(65) Prior Publication Data

US 2015/0044950 A1 Feb. 12, 2015

(30) Foreign Application Priority Data

Aug. 12, 2013 (TW) ..... 102128884 A

(51) Int. Cl.

| | |
|---|---|
| ***B24B 53/017*** | (2012.01) |
| ***B24B 53/12*** | (2006.01) |
| ***B24B 53/02*** | (2012.01) |
| ***B24D 7/02*** | (2006.01) |

(52) U.S. Cl.

CPC ..... *B24B 53/017* (2013.01); *B24B 53/12* (2013.01); *B24D 7/02* (2013.01)

(58) Field of Classification Search

CPC ..... B24B 53/017; B24B 53/02; B24B 53/12

See application file for complete search history.

(56) References Cited

U.S. PATENT DOCUMENTS

| | | | | |
|---|---|---|---|---|
| 8,398,466 | B2 * | 3/2013 | Sung et al. | 451/443 |
| 2009/0098807 | A1 * | 4/2009 | Bakshi et al. | 451/36 |
| 2010/0248596 | A1 * | 9/2010 | Sung | 451/56 |
| 2011/0275288 | A1 * | 11/2011 | Sung | 451/56 |
| 2012/0302146 | A1 * | 11/2012 | Sung | 451/443 |
| 2015/0004787 | A1 * | 1/2015 | Hung et al. | 438/692 |

* cited by examiner

*Primary Examiner* — Dung Van Nguyen

(74) *Attorney, Agent, or Firm* — Kirton McConkie; Evan R. Witt

(57) ABSTRACT

A pad conditioning tool includes a sapphire substrate with a specific orientation plane, wherein the specific orientation plane is selected from a group consisting of a-plane, c-plane, r-plane, m-plane, n-plane and v-plane, the sapphire substrate further defining a mounting surface; and a plurality of sapphire dressing particles and a plurality of scrapers formed on the mounting surface of the substrate in a predetermined geometric arrangement, wherein the dressing particles are scattered between an adjacent pair of the scrapers. In case a wafer polishing pad is conditioned by the dressing particles of the pad conditioning tool, the scrapers are capable of removing abrasive waste and particles from the wafer polishing pad during a dressing operation, thereby forming new trenches and cilia structure on a polishing surface of the wafer polishing pad.

10 Claims, 15 Drawing Sheets

PAD CONDITIONING TOOL HAVING SAPPHIRE DRESSING PARTICLES

CROSS-REFERENCES TO RELATED APPLICATION

This application claims the priority of Taiwanese patent application No. 102128884, filed on Aug. 12, 2013, which is incorporated herewith by reference.

BACKGROUND OF THE INVENTION

1. Field of the Invention

The present invention relates generally to a pad conditioning tool for Chemical Mechanical Polishing (CMP) process, and more particularly a pad conditioning tool that has a plurality of sapphire dressing particles for dressing a wafer polishing pad such that the wafer polishing pad possesses high efficient polishing yield.

2. The Prior Arts

Rapid advance of semiconductor product and optical instrument demands minimizing width of circuit paths in the integrated circuit board. The more the circuits are integrated into a chip, the more planarization of surfaces in the semiconductor material is required, since formation of a circuit or thin film is obtained only after each deposition process. To be more specific, if the integrated circuit includes 10 conductive layers (like Cu, Al, W), insulated layers (like black diamond) and anti-abrasive layer, several deposition processes are conducted so as to form the 10 conductive layers. Since smoothing of the surface is required after formation of each layer, presently Chemical Mechanical Polishing (CMP) technique is generally applied in the production of a semiconductor, which in fact is a process of smoothing surfaces of silicone wafers or other base material with the combination of chemical and mechanical forces, so that it is named CMP. The CMP technique generally includes two parts, namely, (I) polishing the semiconductor surface with a polishing pad; and (II) conditioning the polishing pad to provide effective polishing ability. FIG. 1 illustrates a conventional pad conditioning tool, which conducts conditioning of the polishing pad 3 while the polishing pad 3 conducts polishing operation on a wafer simultaneously without the need of stopping the operation. As shown, a rotary device 5 is mounted at each back of the conventional pad conditioning tool 2 and the wafer 1 so as to cause the former to rotate relative to the polishing pad 3.

The conventional pad conditioning tool generally includes a plurality of diamond particles formed on a metal substrate via hard brazing process. Because the diamond particles protrude outwardly from the outer surface at different heights, the exterior appearance and dimension or height is not uniform so that the diamond conditioning tool can only provide roughly about 40% polishing effect. Note that thousands of diamond particles are electroplated or via hard brazing process onto the metal substrate so that there exists co-relation between the surface areas and the number of diamond particles mounted within the surface area and the diamond particles at the adjoining surfaces may fall off owing to contraction and expansion of the metal substrate at different temperatures. The diamond particles may fall off upon introduction of the slurry and the etching process on the metal substrate or the tips of the diamond particles break off owing to non-uniform strength, which, in turn, may result in scratches partially or wholly on the wafer being polished. Of late, a pad conditioning tool has been developed, which includes an integrally formed polishing pad made from relatively hard sapphire material and which are exposed to an exterior more evenly and thus provides longer service life and efficient polishing rate. However, the polishing surface of the polishing pad conditioned by the above-mentioned pad conditioning tool still suffers a new cilia and trench error of 10~20 μm, which needs to be overcome.

SUMMARY OF THE INVENTION

Therefore, how to develop a pad conditioning tool, which does not suffer the disadvantages, like the diamond particles falling off the metal substrate owing to expansion and contraction of the metal substrate at different temperatures, etching of the adhesion layer in coming contact with the polishing slurry, resulting of scratches on the surface of the article being polished, the tool serving a longer service life and providing high yield of the finished products.

A primary objective of the present invention is to provide a pad conditioning tool which is capable of wiping the undesired abrasive waste and micro particles entirely and clearly from the polishing pad and simultaneously forming new trenches and cilia structure in the polishing surface. The pad conditioning tool of the present invention includes a sapphire substrate with a specific orientation plane, wherein the specific orientation plane is selected from a group consisting of a-plane, c-plane, r-plane, m-plane, n-plane and v-plane, the sapphire substrate further defining a mounting surface; and a plurality of sapphire dressing particles and a plurality of scrapers formed on the mounting surface of the substrate in a predetermined geometric arrangement, wherein the dressing particles are scattered between an adjacent pair of the scrapers. In case a wafer polishing pad is conditioned by the dressing particles of the pad conditioning tool, the scrapers are capable of removing abrasive waste and particles entirely and clearly from the wafer polishing pad during a dressing operation, thereby forming new trenches and cilia structure on a polishing surface of the wafer polishing pad.

In one embodiment, the sapphire substrate has a center axis or an eccentric axis and an outer periphery. Each of the scrapers extends radially or inwardly from the outer periphery and terminating adjacent to the center axis or the eccentric axis.

Preferably, each of the scrapers is elongated and extends in a straight line to terminate adjacent to the center axis or eccentric axis.

Alternately, each of the scrapers is curved and extends in a curved line to terminate adjacent to the center axis or eccentric axis.

Each of the dressing particles is shaped like a symmetric truncated cone with a flat head.

Each of the dressing particles and each of the scrapers respectively have a height difference therebetween. Preferably, the height difference between the dressing particle and the scraper ranges 3~15 μm.

Alternately, the height difference between the dressing particle and the scraper ranges 3~50 μm.

Each of the dressing particles and each of the scrapers are respectively shaped like an asymmetric truncated cone with a flat head.

Preferably, the flat head of each of the dressing particles and the flat head of each of the scrapers have different widths measured in a transverse direction of their respective top and the widths are different from each other by less than 50 μm.

In one embodiment of the present invention, the sapphire substrate defines two opposite mounting surfaces. The sapphire dressing particles and the scrapers are formed on the mounting surfaces of the sapphire substrate in the predetermined geometric arrangement.

Owing to the specific geometric arrangement between the dressing particles and the scrapers, the undesired abrasive waste and micro particles from the wafer polishing pad are wiped off entirely and clearly during the dressing operation, thereby forming new trenches and cilia structure on a polishing surface of the wafer polishing pad.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

The accompanying drawings are included to provide a further understanding of the invention, and are incorporated in and constitute a part of this specification. The drawings illustrate embodiments of the invention and, together with the description, serve to explain the principles of the invention.

Figure 1:
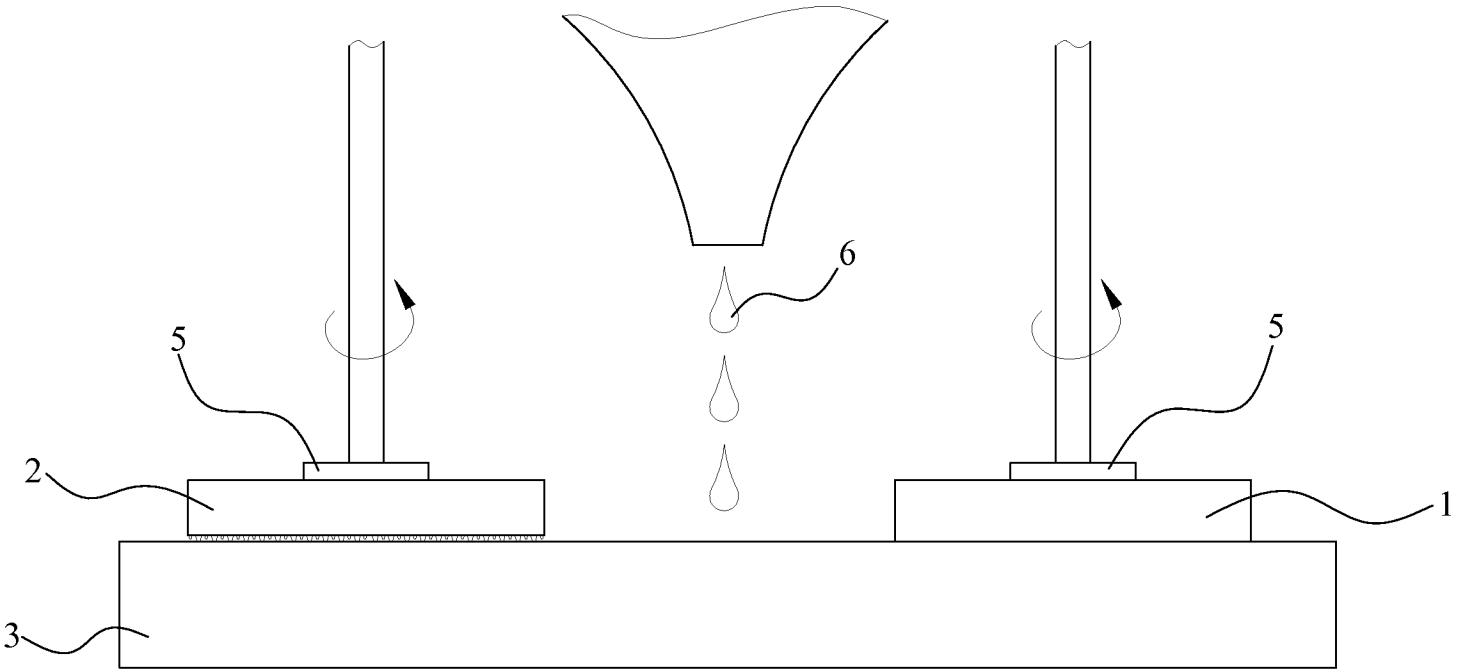
FIG. 1 illustrates a conventional pad conditioning tool.
Figure 2:
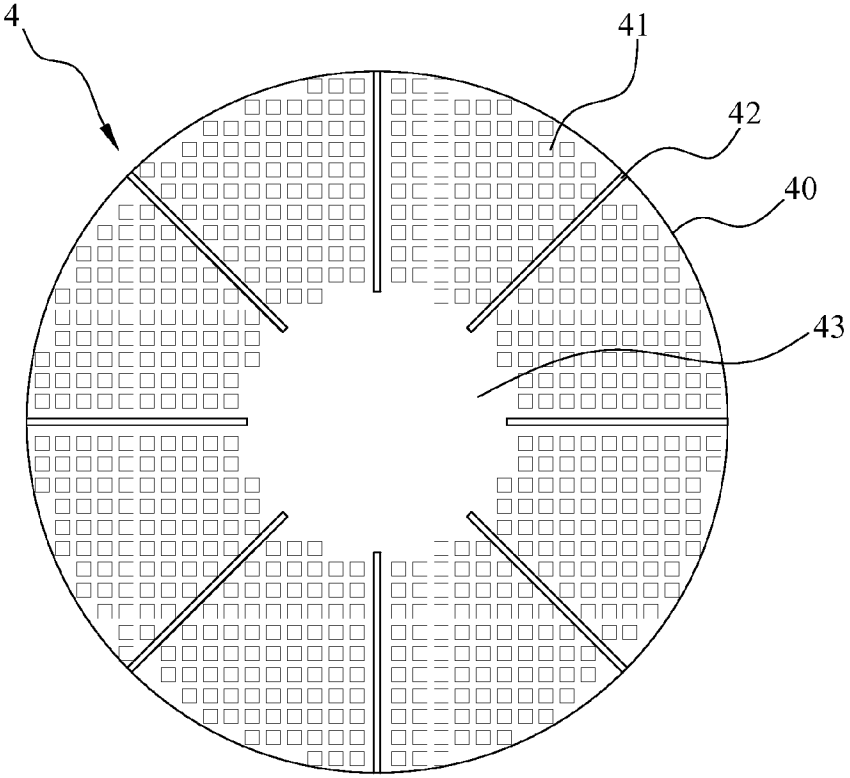
FIG. 2 shows a top planar view of the first embodiment of a pad conditioning tool of the present invention.

FIG. 2 shows a top planar view of the first embodiment of a pad conditioning tool 4 of the present invention. As shown, the pad conditioning tool 4 of the present invention includes a sapphire substrate 40 with a specific orientation plane, wherein the specific orientation plane is selected from a group consisting of a-plane, c-plane, r-plane, m plane, n-plane and v-plane, the sapphire substrate 40 further defining a mounting surface; and a plurality of sapphire dressing particles 41 and a plurality of scrapers 42 formed on the mounting surface of the sapphire substrate 40 in a predetermined geometric arrangement, wherein the dressing particles 41 are scattered between an adjacent pair of the scrapers 42. In case a wafer polishing pad 3 is conditioned by the dressing particles 41 of the pad conditioning tool 4 of the present invention, the scrapers 42 are capable of removing the undesired abrasive waste and micro particles entirely and clearly from the wafer polishing pad 3 (see FIG. 1) during a dressing operation, thereby forming new trenches and cilia structure on a polishing surface of the wafer polishing pad 3, which in turn, provide high efficient polishing effects to the wafer polishing pad 3. Of course, a rotary device 5 should be installed in the pad conditioning tool 4 of the present invention for driving the same. To be more specific, the pad conditioning tool 4 of the present invention should reserve a circular mounting space 43 for installation of the rotary device 5.

In this embodiment, the dressing particles 41 and the scrapers 42 do not overlap relative to each other. According to the present invention, the sapphire substrate 40 has a center axis and an outer periphery. Each of the scrapers 42 extends radially and inwardly from the outer periphery and terminating adjacent to the center axis. Each of the scrapers 42 is preferably elongated and thus extends in a straight line. When a wafer polishing pad 3 is conditioned by the dressing particles 41 of the pad conditioning tool 4 of the present invention, the scrapers 42 are capable of removing the undesired abrasive waste and micro particles entirely and clearly from the wafer polishing pad 3 during the dressing operation, thereby forming new trenches and cilia structure on a polishing surface of the wafer polishing pad 3.

The growth techniques of the sapphire substrate 40 to possess the specific orientation direction, includes ingot coring, tail cutting, end plane grinding, cylindrical grinding, multi-wire saw cutting, single or double side lapping and polishing to form the sapphire substrate. Later, coating a photo resistance layer, photolithography process, wet or dry etching, hard baking, deposition process are conducted and these actions are not directly related to the pad conditioning tool of the present invention and thus is omitted herein for the sake of brevity.

Figure 3:
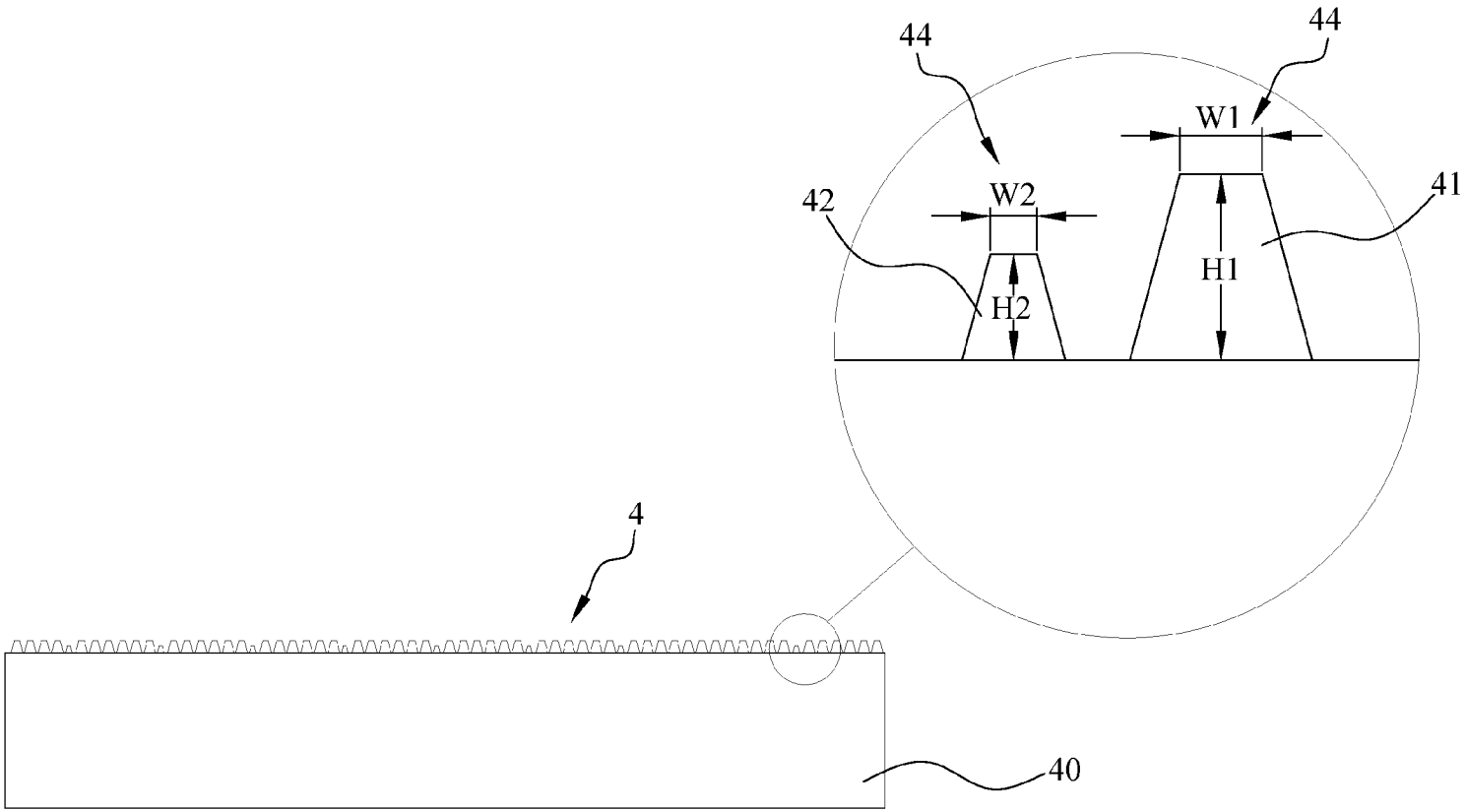
FIG. 3 illustrates a lateral side view of the pad conditioning tool of the present invention.

FIG. 3 illustrates a lateral side view of the pad conditioning tool 4 of the present invention, wherein the enlarged and encircled portion shows one sapphire dressing particle 41 which has a height H1 and a scraper 42 which has a height H2. In other words, the height difference between the dressing particle 41 and the scraper 42 ranges 3~15 μm. To be more specific, a pad conditioning tool having a height difference ranging 3~15 μm between the dressing particle 41 and the scraper provides a more planarization effect when compared to another pad conditioning tool having a height difference ranging 3~50 μm.

It is to note that the height H1 of each dressing particle 41 should be greater than the height H2 of each scraper 42, since the tips of the dressing particles 41 must be exposed to an exterior of the scrapers 42, only then the conditioning of a wafer polishing pad can be carried out so as to permit formation of new trenches and cilia structure in the wafer polishing pad. The scrapers 42 is required to remove the undesired abrasive waste and micro particles from the wafer polishing pad 3 when the same is being conditioned by the pad conditioning tool 4 of the present invention. The pad conditioning tool 4 of the present invention provides high efficient performance if each dressing particle 41 and the scraper 42 is shaped like a symmetric truncated cone with a flat head, as best shown in FIG. 3. In other words, the flat head of each of the dressing particles 41 and the flat head of each of the scrapers 42 have different widths (W1, W2) measured in a transverse direction of their respective top and the widths are different from each other by less than 50 μm, preferably, ranging 0~20 μm.

Figure 4:
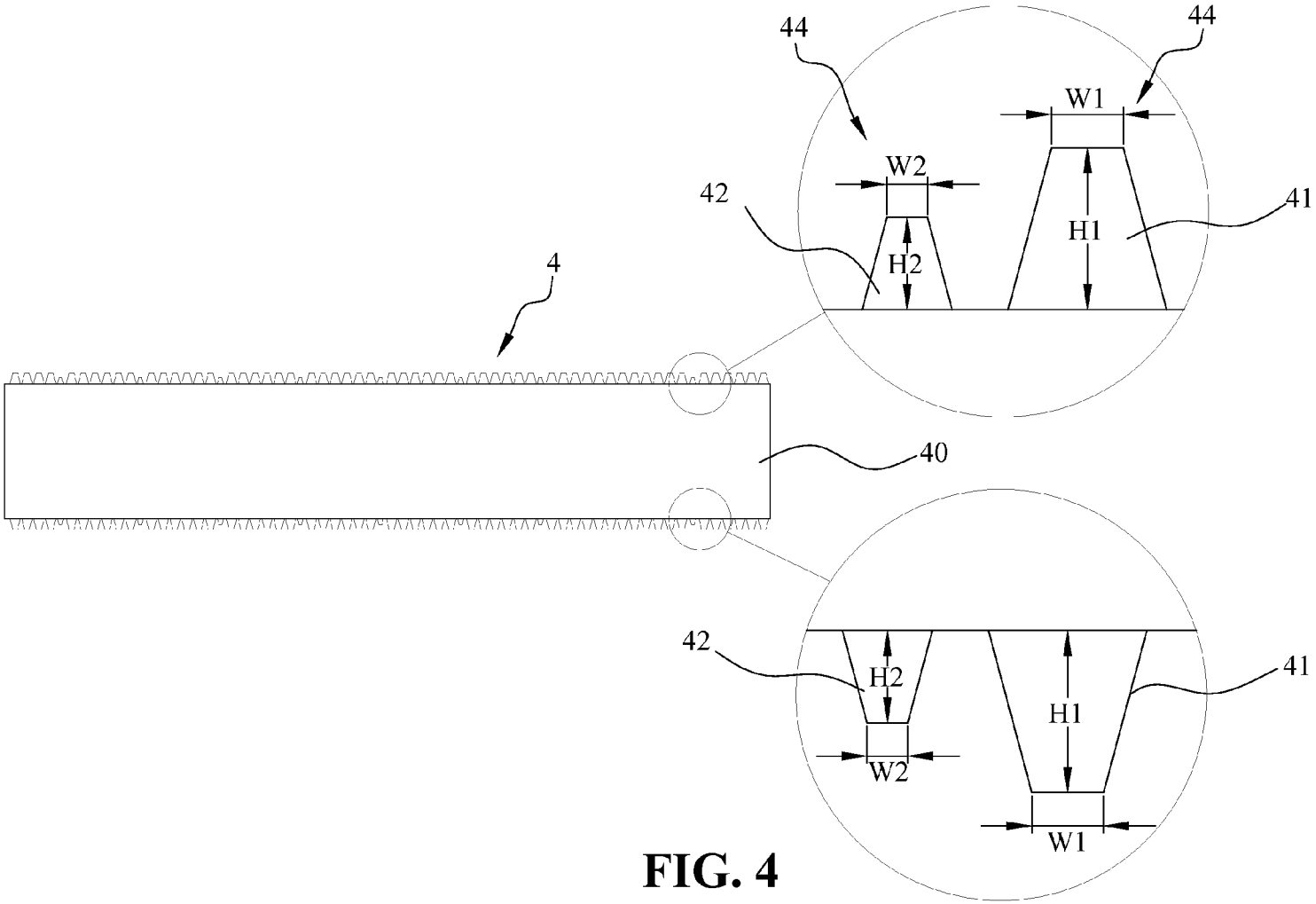
FIG. 4 illustrates a lateral side view of a modified pad conditioning tool of the present invention.

FIG. 4 illustrates a lateral side view of a modified pad conditioning tool 4 of the present invention. As illustrated, in order to provide more high efficient performance, the sapphire substrate 40 defines two opposite mounting surfaces. The sapphire dressing particles 41 and the scrapers 42 are formed on the mounting surfaces of the sapphire substrate 40 in the predetermined geometric arrangement. The structure of the dressing particles 41 and the scrapers 42 is the same as the previous embodiment, the detailed description thereof is omitted herein.

Figure 5:
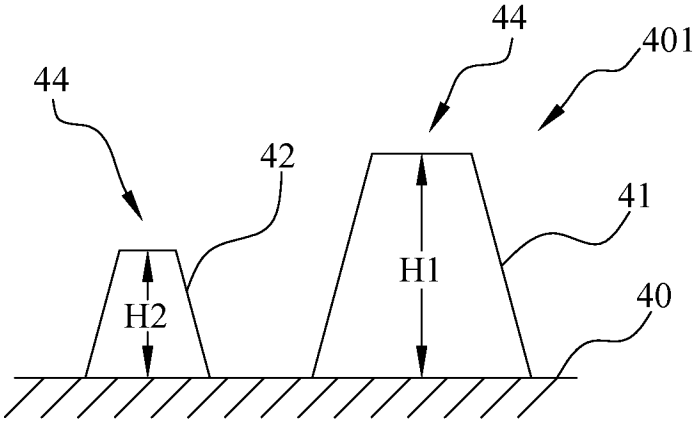
FIG. 5 shows configuration of a sapphire dressing particle and a scraper employed in the pad conditioning tool of the present invention.
Figure 6:
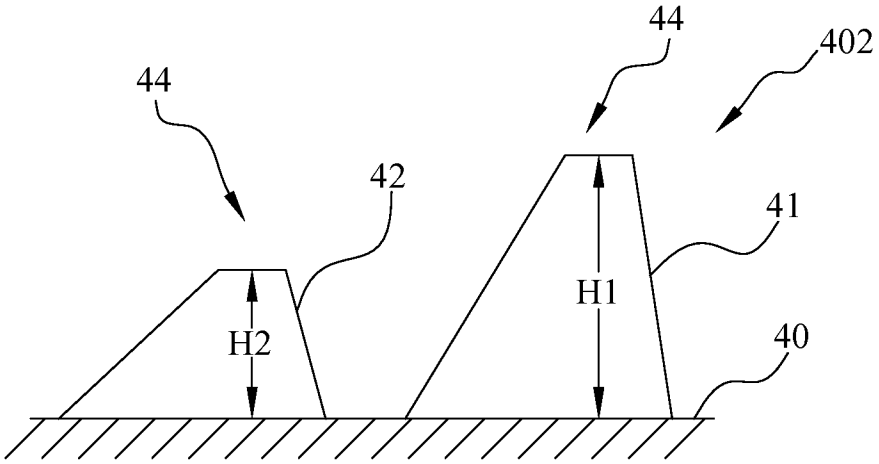
FIG. 6 shows another configuration of the sapphire dressing particle and the scraper employed in the pad conditioning tool of the present invention.
Figure 7:
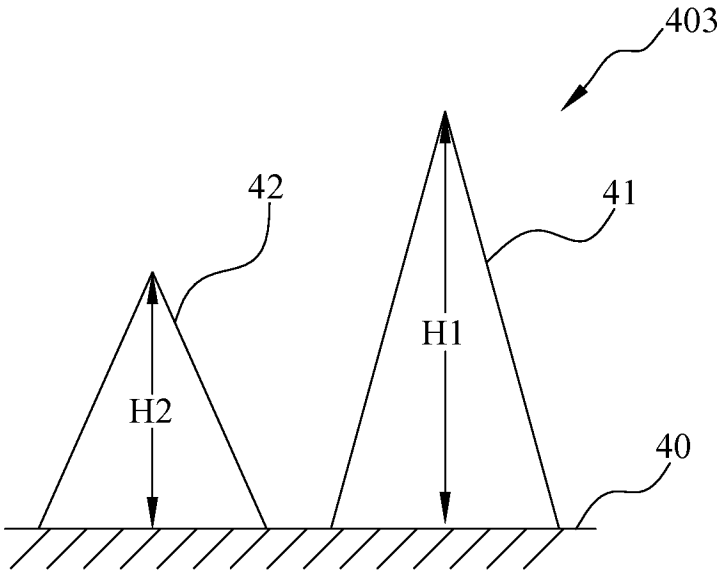
FIG. 7 shows yet another configuration of the sapphire dressing particle and the scraper employed in the pad conditioning tool of the present invention.
Figure 8:
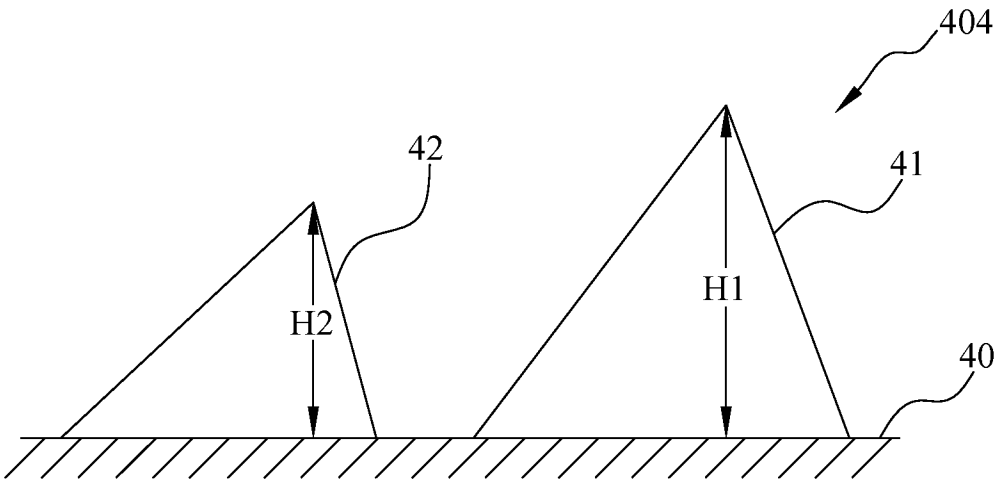
FIG. 8 shows yet another configuration of the sapphire dressing particle and the scraper employed in the pad conditioning tool of the present invention.

Referring to FIGS. 5~8, wherein FIG. 5 shows configuration of the sapphire dressing particle 41 and the scraper 42 employed in the pad conditioning tool 4 of the present invention, where each dressing particle 41 and each scraper 42 are shaped like a symmetric truncated cone 401 with a flat head; FIG. 6 shows another configuration of the sapphire dressing particle 41 and the scraper 42 employed in the pad conditioning tool 4 of the present invention, where each dressing particle 41 and each scraper 42 are shaped like an asymmetric truncated cone 402 with a flat head; FIG. 7 shows yet another configuration of the sapphire dressing particle 41 and the scraper 42 employed in the pad conditioning tool 4 of the present invention, where each dressing particle 41 and each scraper 42 are shaped like a symmetric cone 403; and FIG. 8 shows yet another configuration of the sapphire dressing particle 41 and the scraper 42 employed in the pad conditioning tool 4 of the present invention, where each dressing particle 41 and each scraper 42 are shaped like an asymmetric cone 404.

In order to achieve the height difference between the dressing particle 41 and the scraper 42, twice coating and deposition processes are required to form two photo resistance layers. Each process includes coating photo resistance material, lithographic exposure, hard baking and wet or dry etching operations and etc to form the dressing particle 41 and the scraper 42, where both posses the same height while another process results the height difference between the dressing particle 41 and the scraper 42. Any other fabrication means can be performed so long as they provide the targeted features.

Figure 9:
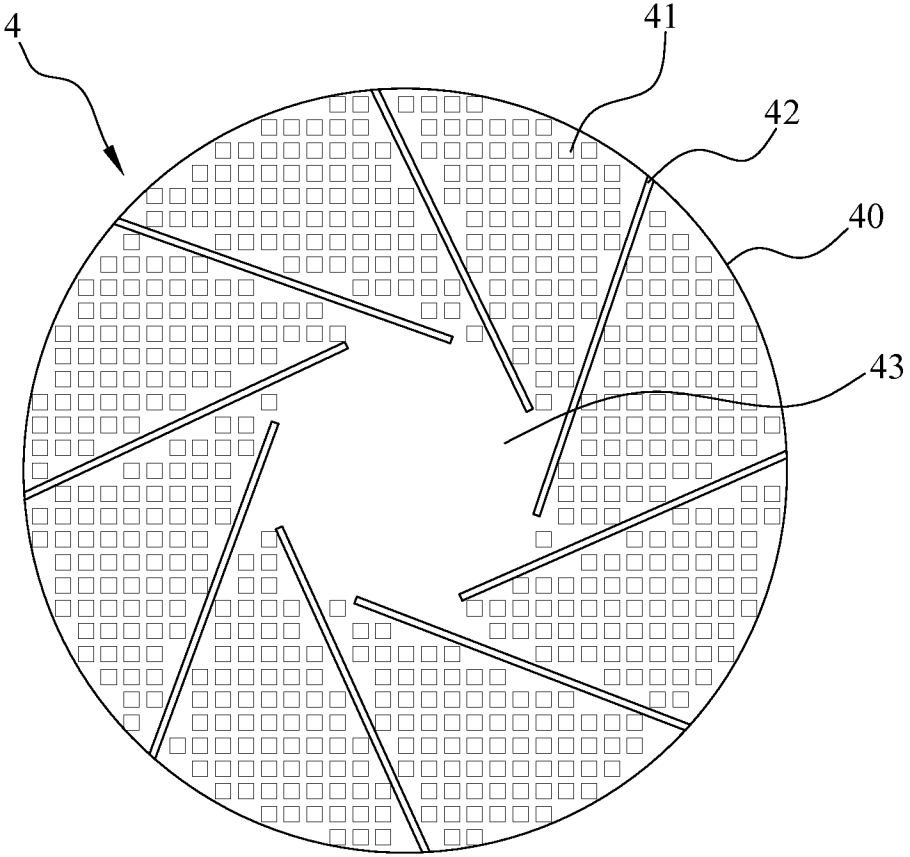
FIG. 9 shows a top planar view of the second embodiment of the pad conditioning tool of the present invention.

FIG. 9 shows a top planar view of the second embodiment of the pad conditioning tool of the present invention, wherein the second embodiment is generally similar to the first embodiment, except in that the sapphire substrate 40 has a center axis 43 and an outer periphery. Each of the scrapers 42 extends inwardly from the outer periphery and terminates adjacent to the center axis 43, thereby forming different angular angle at the outer periphery different from the first embodiment. The length of each scraper 42 can be varied according to the actual requirement.

Figure 10:
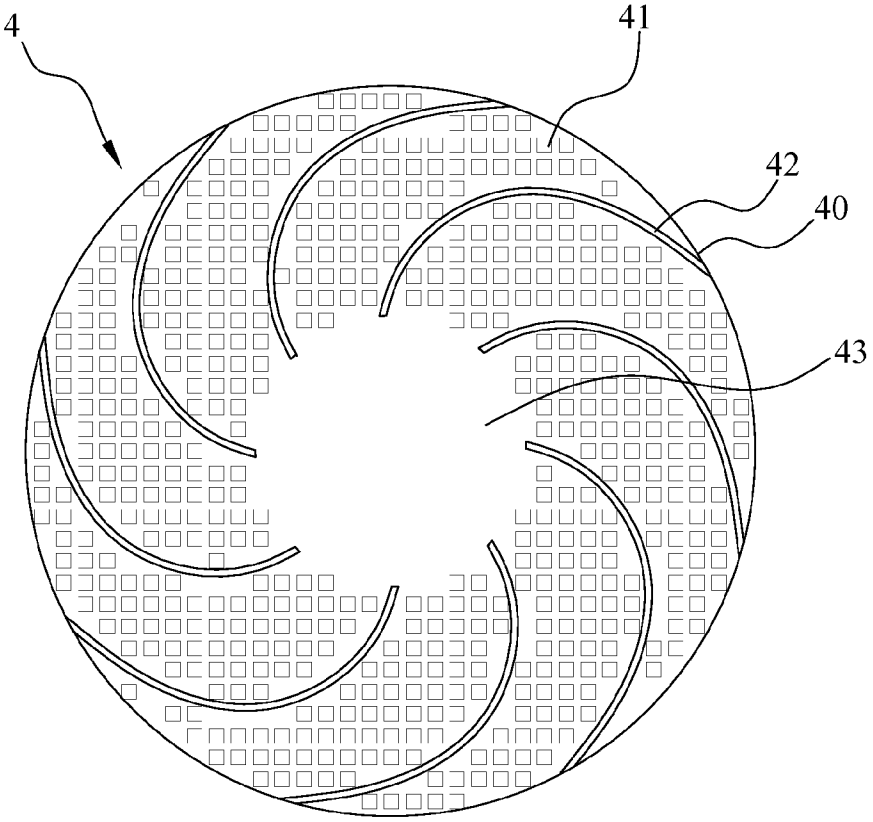
FIG. 10 shows a top planar view of the third embodiment of the pad conditioning tool of the present invention.

FIG. 10 shows a top planar view of the third embodiment of the pad conditioning tool 4 of the present invention, wherein the third embodiment is generally similar to the first embodiment, except that the sapphire substrate 40 has a center axis 43 and an outer periphery. Each of the scrapers 42 is curved and extends from the outer periphery in a curved line to terminate adjacent to the center axis 43, thereby forming a whirlpool on the sapphire substrate 40. The length and curvature of the scrapers 42 can be varied according to the actual requirement and the configuration thereof should not be limited only to the illustrated ones.

Figure 11:
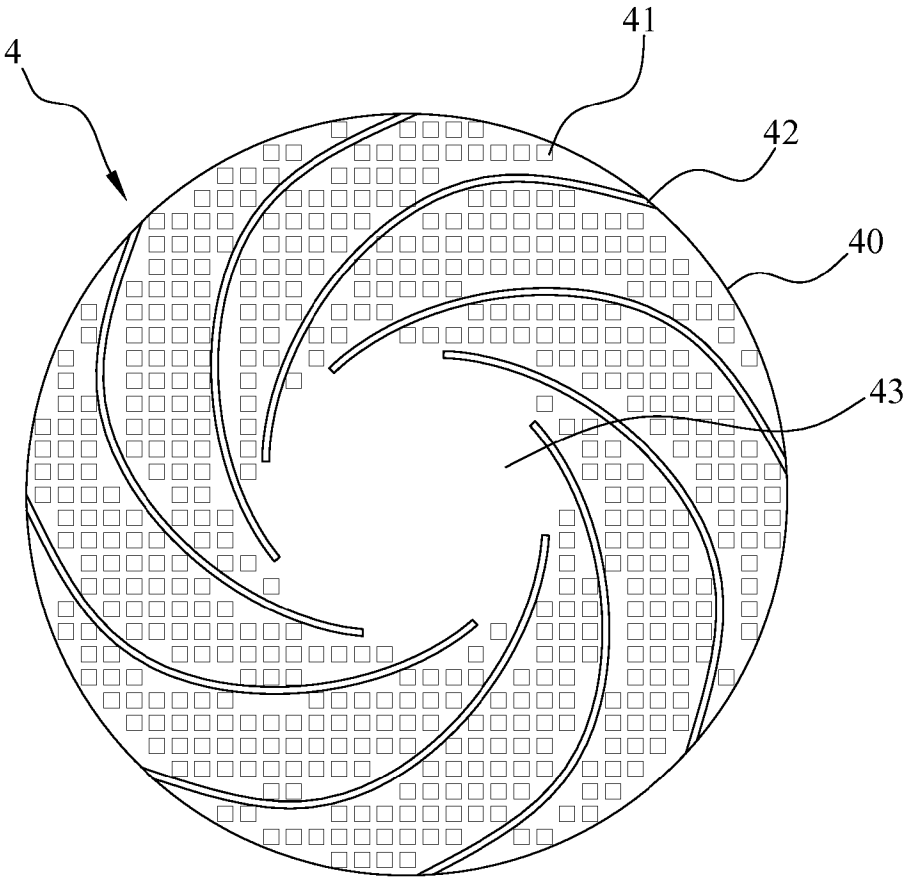
FIG. 11 shows a top planar view of the fourth embodiment of the pad conditioning tool of the present invention.

FIG. 11 shows a top planar view of the fourth embodiment of the pad conditioning tool 4 of the present invention, wherein the fourth embodiment is generally similar to the first embodiment, except that the sapphire substrate 40 has a center axis 43 and an outer periphery. Each of the scrapers 42 is curved and extends from the outer periphery in a curved line to terminate at positions offset to the center axis 43, thereby forming a whirlpool on the sapphire substrate 40. The length and curvature of the scrapers 42 can be varied according to the actual requirement and the configuration thereof should not be limited only to the illustrated ones.

Figure 12:
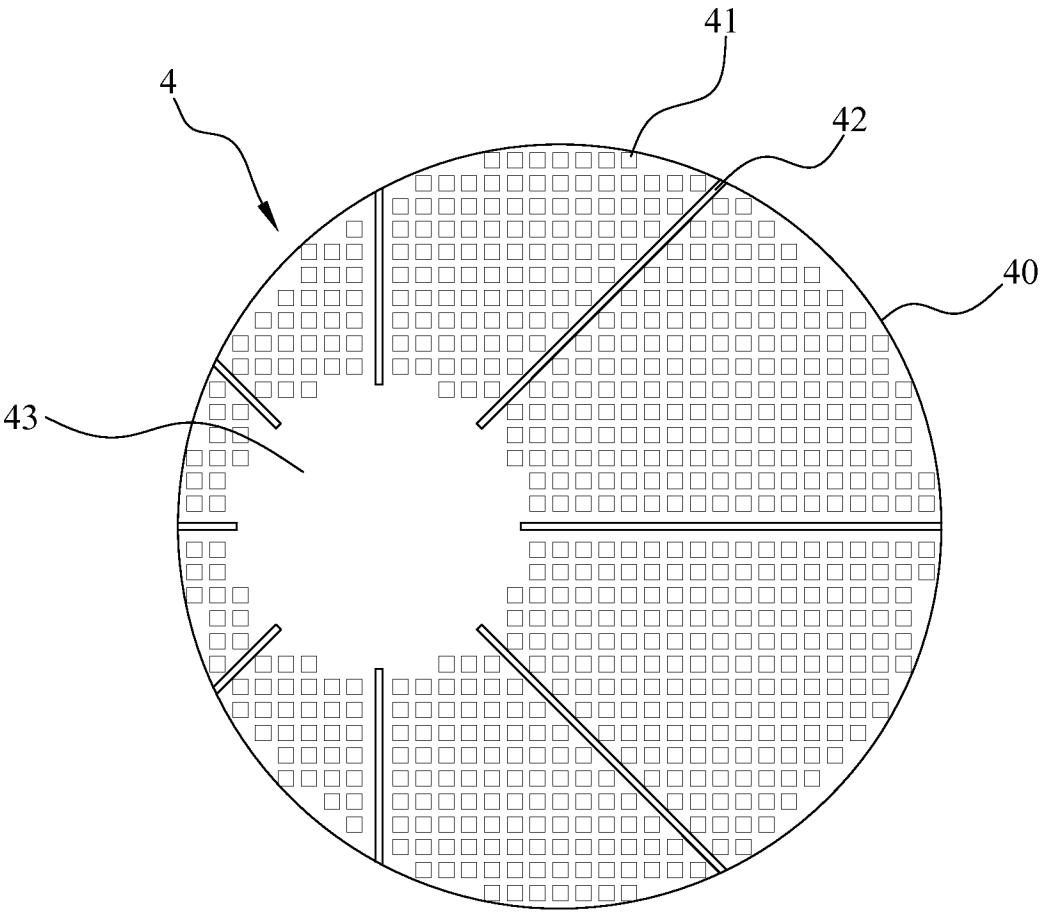
FIG. 12 shows a top planar view of the fifth embodiment of the pad conditioning tool of the present invention.
Figure 13:
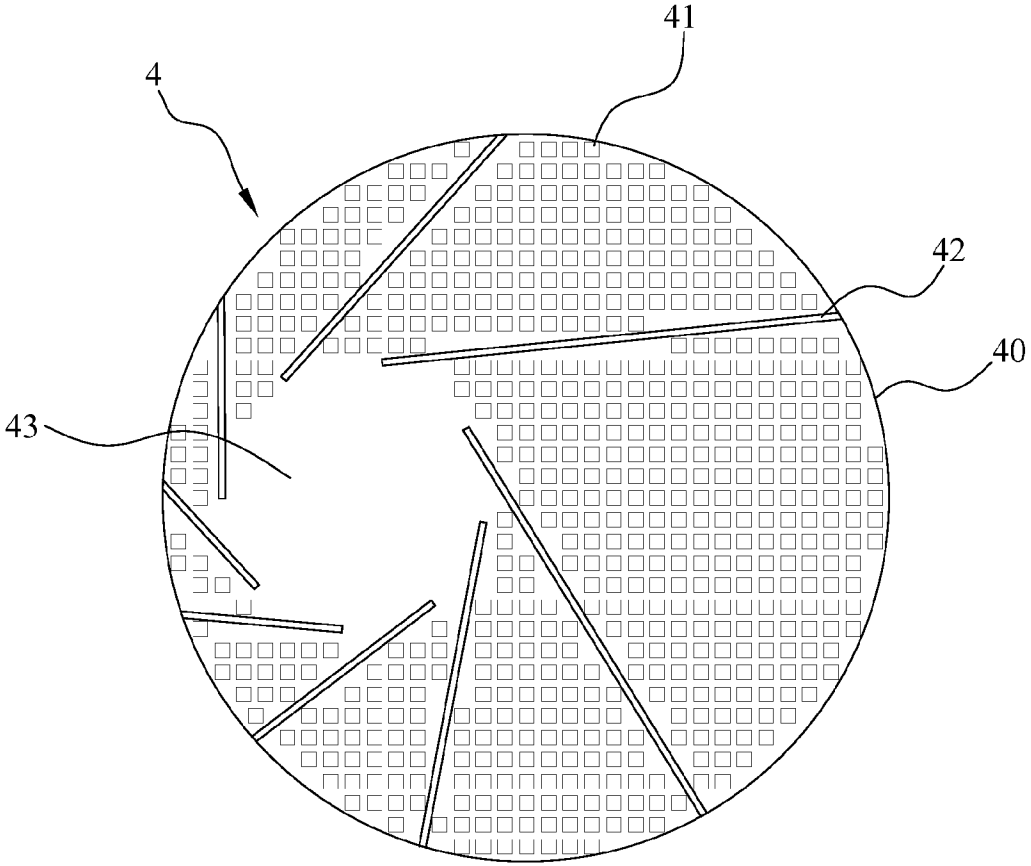
FIG. 13 shows a top planar view of the sixth embodiment of the pad conditioning tool of the present invention.
Figure 14:
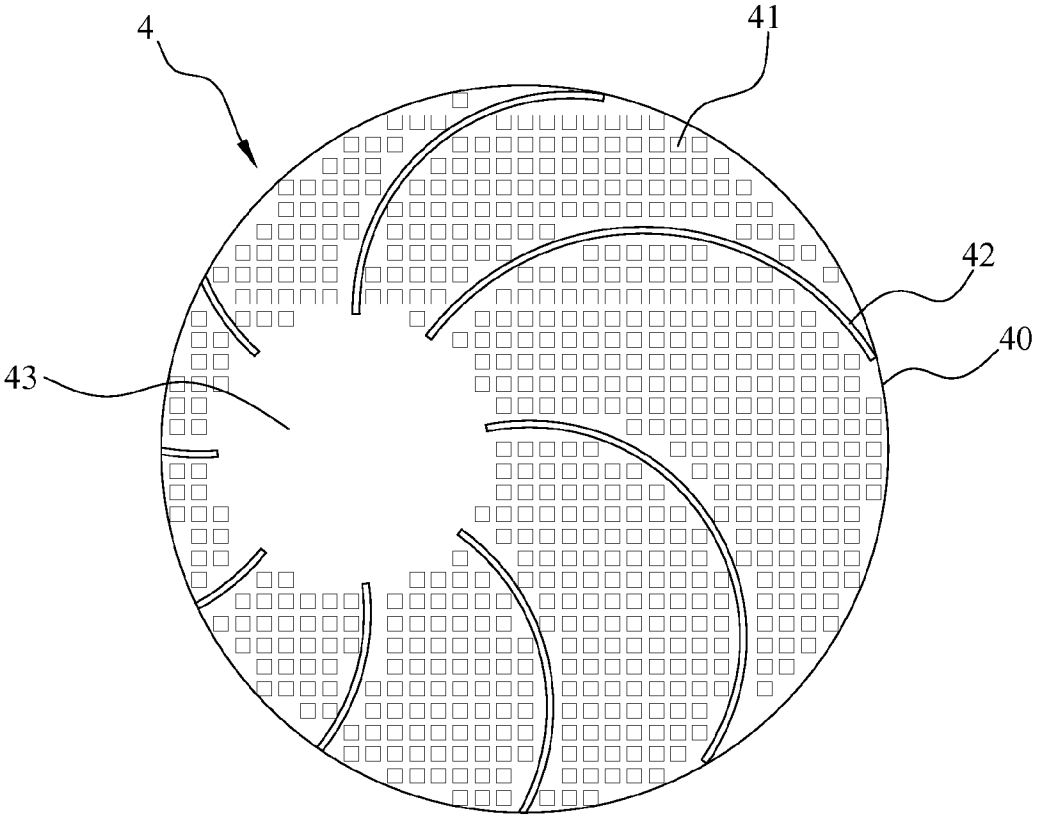
FIG. 14 shows a top planar view of the seventh embodiment of the pad conditioning tool of the present invention.
Figure 15:
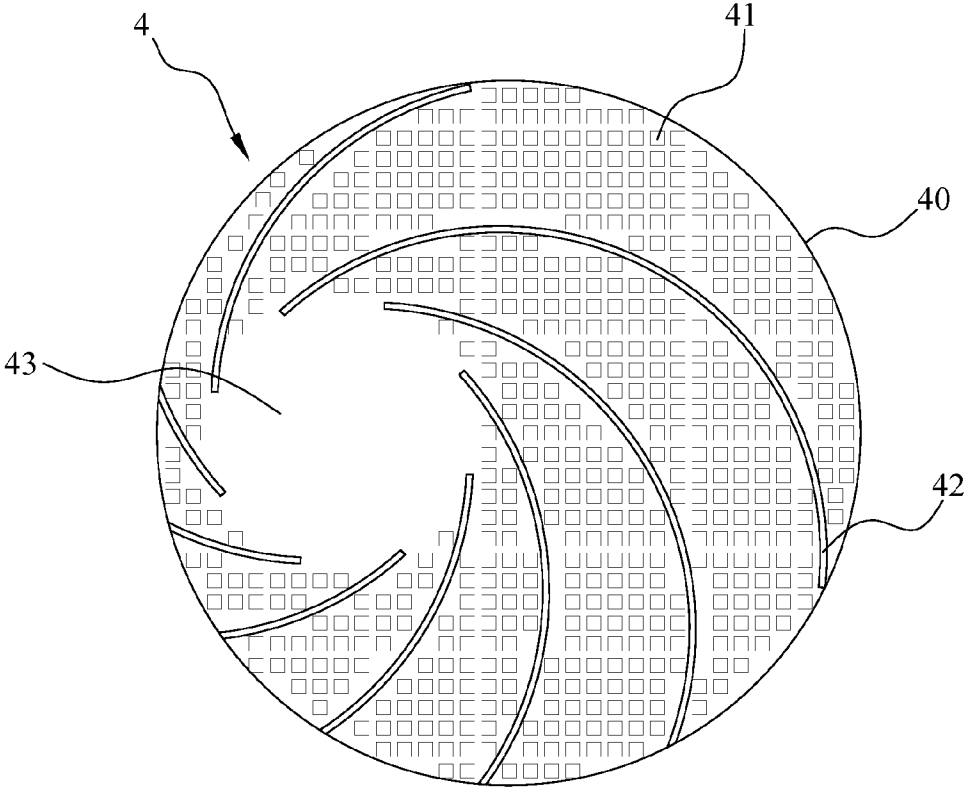
FIG. 15 shows a top planar view of the eighth embodiment of the pad conditioning tool of the present invention.

Referring to FIGS. 12~15, wherein FIG. 12 shows a top planar view of the fifth embodiment of the pad conditioning tool 4 of the present invention, where the sapphire substrate 40 has an eccentric axis 43 and an outer periphery. Each of the scrapers 42 extends inwardly from the outer periphery and terminates adjacent to the eccentric axis 43. FIG. 13 shows a top planar view of the sixth embodiment of the pad conditioning tool 4 of the present invention, where the sapphire substrate 40 has an eccentric axis 43 and an outer periphery. Each of the scrapers 42 extends inwardly from the outer periphery and terminates adjacent to the eccentric axis 43, defining angular angles different from that of the fifth embodiment. FIG. 14 shows a top planar view of the seventh embodiment of the pad conditioning tool 4 of the present invention, where the sapphire substrate 40 has an eccentric axis 43 and an outer periphery. Each of the scrapers 42 extends inwardly and curvedly from the outer periphery and terminates adjacent to the eccentric axis 43, forming a whirlpool. FIG. 15 shows a top planar view of the eighth embodiment of the pad conditioning tool 4 of the present invention, where the sapphire substrate 40 has an eccentric axis 43 and an outer periphery. Each of the scrapers 42 extends inwardly and curvedly from the outer periphery and terminates adjacent to the eccentric axis 43, forming a whirlpool slightly different from that of the seventh embodiment.

It is to note that owing to the above-mentioned eccentric arrangement of the scrapers 42 on the sapphire substrate 40, the undesired abrasive waste and the micro particles are wiped off entirely and clearly from the polishing pad when the former is being conditioned by the pad conditioning tool 4 of the present invention without leaving dead angles. In addition, the layout design or track of the pad conditioning tool of the present is simplified when compared to the prior art ones.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A pad conditioning tool comprising:

a sapphire substrate with a specific orientation plane, wherein said specific orientation plane is selected from a group consisting of a-plane, c-plane, r-plane, m-plane, n-plane and v-plane, said sapphire substrate 40 further defining a mounting surface; and a plurality of sapphire dressing particles and a plurality of scrapers formed on said mounting surface of said sapphire substrate in a predetermined geometric arrangement, wherein each of said scrapers is curved and extends in a curved line, and said dressing particles are scattered between each adjacent pair of said scrapers;

wherein, in case a wafer polishing pad is conditioned by said dressing particles of the pad conditioning tool, said plurality of scrapers are capable of removing abrasive waste and particles entirely and clearly from the wafer polishing pad during a dressing operation, thereby forming new trenches and cilia structure on a polishing surface of the wafer polishing pad, which in turn, provide high efficient polishing effects to the wafer polishing pad.

2. The pad conditioning tool according to claim 1, wherein said sapphire substrate has a center axis and an outer periphery, each of said scrapers extending radially and inwardly from said outer periphery and terminating adjacent to said center axis.

3. The pad conditioning tool according to claim 1, wherein said sapphire substrate has an eccentric axis and an outer periphery, each of said scrapers extending inwardly from said outer periphery and terminating adjacent to said eccentric axis.

4. The pad conditioning tool according to claim 1, wherein each of said dressing particles is shaped like a symmetric truncated cone with a flat head, a symmetric cone, an asymmetric truncated cone with a flat head and an asymmetric cone.

5. The pad conditioning tool according to claim 1, wherein each of said dressing particles and each of said scrapers have a height difference therebetween.

6. The pad conditioning tool according to claim 5, wherein said height difference is in a range of 3~15 μm.

7. The pad conditioning tool according to claim 5, wherein said height difference is in a range of 3~50 μm.

8. The pad conditioning tool according to claim 1, wherein each of said dressing particles and each of said scrapers are shaped like a symmetric truncated cone with a flat head.

9. The pad conditioning tool according to claim 8, wherein said flat head of each of said dressing particles and said flat head of each of said scrapers have different widths measured in a transverse direction of their respective top and the widths are different from each other by less than 50 μm.

10. The pad conditioning tool according to claim 1, wherein said sapphire substrate further defines two opposite mounting surfaces, said sapphire dressing particles and said scrapers are formed on said mounting surfaces of said sapphire substrate in said predetermined geometric arrangement.

* * * * *